US006858979B2

(12) United States Patent
Park et al.

(10) Patent No.: US 6,858,979 B2
(45) Date of Patent: Feb. 22, 2005

(54) PLASMA FLAT LAMP

(75) Inventors: Hyoung-bin Park, Kyungki-do (KR); Gi-young Kim, Chungcheongbuk-do (KR); Ji-hyun Hong, Kyungki-do (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 44 days.

(21) Appl. No.: 10/301,634

(22) Filed: Nov. 22, 2002

(65) Prior Publication Data

US 2003/0098643 A1 May 29, 2003

(30) Foreign Application Priority Data

Nov. 22, 2001 (KR) ..... 2001-73017

(51) Int. Cl.[7] ..... H01J 1/62; H01J 63/04; H01J 17/49

(52) U.S. Cl. ..... 313/495; 313/484; 313/631; 313/582; 313/113

(58) Field of Search ..... 313/495, 483, 313/484, 631, 627, 632, 582, 594, 607, 234, 113; 315/169.4, 330

(56) References Cited

U.S. PATENT DOCUMENTS

| | | | | | |
|---|---|---|---|---|---|
| 5,051,648 | A | * | 9/1991 | Misono et al. | 313/13 |
| 5,343,115 | A | * | 8/1994 | Anandan et al. | 313/491 |
| 5,592,047 | A | * | 1/1997 | Park et al. | 313/484 |
| 6,333,600 | B1 | * | 12/2001 | Mizobata | 313/587 |
| 2002/0079826 | A1 | * | 6/2002 | Park | 313/483 |
| 2002/0117959 | A1 | * | 8/2002 | Winsor | 313/484 |

FOREIGN PATENT DOCUMENTS

KR A-2003-31824 4/2003

OTHER PUBLICATIONS

Y. Ikeda et al.; 37.3: Mercury–Free, Simple–Structured Flat Discharge LCD Backlights Ranging from 0.5 to 5.2–in. Diagonals; Technical Paper; 2000; pp. 938–941; Society for Information Display International Symposium Digest of Technical Papers.

M. Ilmer et al.; 37.1: Invited Paper: Hg–free Flat Panel Light Source PLANON®—a Promising Candidate for Future LCD Backights; Technical Paper; 2000; pp. 931–933; Society for Information Display International Symposium Digest of Technical Papers.

Choi, J.Y., et al., *13.3: Mercury–Free, 18" class flat fluorescent Lamp with good uniformity*, Proceedings of the 1st International Display Manufacturing Conference, 21 (2000), pp. 1–2.

* cited by examiner

*Primary Examiner*—Ashok Patel
(74) *Attorney, Agent, or Firm*—Burns, Doane, Swecker & Mathis, L.L.P.

(57) ABSTRACT

A plasma flat lamp includes an upper plate, a lower plate separated a predetermined distance from the upper plate, a wall portion for forming a sealed discharge space between the upper and lower plates, a discharge gas filled in the discharge space, a first pair of electrodes including a first upper plate electrode and a first lower plate electrode arranged to face each other on each of the upper and lower plates with the discharge space interposed therebetween, and a second pair of electrodes including a second upper plate electrode separated a predetermined distance from the first upper plate electrode and a second lower plate electrode separated a predetermined distance from the first lower plate electrode arranged to face each other on each of the upper and lower plates with the discharge space interposed therebetween. Thus, the plasma flat lamp according to the present invention has a stable discharge feature which is a merit of the conventional electrodes discharge flat lamp and a high luminance of light emission which is a feature of the facing surfaces discharging type, while not having a low luminance and unstable discharge feature of the conventional surface discharge type flat lamp and facing electrodes discharging flat lamp, respectively.

32 Claims, 11 Drawing Sheets

PLASMA FLAT LAMP

BACKGROUND OF THE INVENTION

This application claims the priority of Korean Patent Application No. 2001-73017 filed 22, Nov. 2001, in the Korean Intellectual Property Office, the disclosure of which is incorporated herein in its entirety by reference.

1. Field of the Invention

The present invention relates to a plasma flat lamp, and more particularly, to a plasma flat lamp having a high luminance, a high efficiency of light emission, and a uniform distribution of luminance.

2. Description of the Related Art

Flat lamps mainly used as back-lights of LCDs have been developed into surface discharge type or facing electrodes discharge type plasma lamps, in which the entire space under a light emitting surface makes a discharge space considering the efficiency of light emission and uniformity of luminance of light emission, from the conventional edge-light or direct-light type plasma lamps using a cold cathode fluorescent lamp.

In general, the surface discharge type is advantageous in that a discharge feature is stable compared to the facing electrodes discharge type. However, the overall luminance of the surface discharge type is lower than that of the facing electrodes discharge type. As an example of a conventional surface discharge flat lamp, there is a lamp in which the overall discharge space is divided into fine discharge areas to prevent local concentration of discharge. This lamp can discharge stably. However, since the uniformity of the overall luminance of light emission is inferior due to a difference in the luminance of light emission between the fine discharge areas and a gap between the fine discharge areas, a diffusing paper or diffusing plate is needed to uniformly diffuse light (M. Ilmer et al., Society for Information Display International Symposium Digest of Technical Papers 31, 931 (2000)).

FIG. 1 shows another example of the conventional surface discharge type flat lamp. A discharge space filled with a discharge gas is formed between an upper plate 1 and a lower plate 2 separated by a wall portion 7. Electrodes 3 and 4 for discharge are formed at both sides of an inner surface of the lower plate 2. A dielectric layer 5 is formed on each of the electrodes 3 and 4. A fluorescent layer 6 is formed on each of the inner surfaces of the upper and lower plates 1 and 2. The conventional surface discharge type flat lamp having the above structure has been known to have a low luminance due to its discharge characteristic (Y. Ikeda et al., Society for Information Display International Symposium Digest of Technical Papers 31, 938 (2000)).

FIG. 2 shows an example of the conventional facing electrodes discharge type flat lamp. An upper plate 1*a* and a lower plate 2*a* are separated a predetermined distance from each other by a wall portion 7*a* and a discharge space is provided therebetween. Electrodes 3*a* and 4*a* for discharge are formed on inner surfaces of the upper and lower plates 1*a* and 2*a* to face each other. A fluorescent layer 6*a* is formed on each of the electrodes 3*a* and 4*a*. The upper and lower plates facing electrodes discharge type flat lamp having the above structure has a high luminance compared with the surface discharge type flat lamp shown in FIG. 1, but has a low efficiency of discharge and an unstable discharge due to excessive current (J. Y. Choi et al., Proceedings of the 1$^{st}$ International Display Manufacturing Conference, 21 (2000)).

FIG. 3 shows yet another example of the conventional facing electrodes discharge type flat lamp. Electrodes 3*b* and 4*b* are formed to face each other on inner surfaces of a wall portion 7*b* facing each other. Each of the electrodes 3*b* and 4*b* is protected by a dielectric layer 5*b*. Upper and lower plates 1*b* and 2*b* are separated by the wall portion 7*b*. A discharge space in which a discharge between the electrodes 3*b* and 4*b* is induced is provided between the electrodes 3*b* and 4*b*. A fluorescent layer 6*b* is formed on each of inner surfaces of the upper and lower plates 1*b* and 2*b*. The side wall portion facing electrodes discharge flat lamp having the above structure can prevent excessive current. However, discharge is unstable, in particular, discharge tends to concentrate on a local point.

As described above, in the conventional flat lamps, it is disadvantageous that either luminance is low while discharge is stable or luminance is high while discharge is unstable.

SUMMARY OF THE INVENTION

To solve the above-described problems, it is an object of the present invention to provide a plasma flat lamp having a high luminance and a stable discharge feature.

To achieve the above object, there is provided a plasma flat lamp comprising an upper plate, a lower plate separated a predetermined distance from the upper plate, a wall portion for forming a sealed discharge space between the upper and lower plates, a discharge gas filled in the discharge space, a first pair of electrodes including a first upper plate electrode and a first lower plate electrode arranged to face each other on each of the upper and lower plates with the discharge space interposed therebetween, and a second pair of electrodes including a second upper plate electrode separated a predetermined distance from the first upper plate electrode and a second lower plate electrode separated a predetermined distance from the first lower plate electrode arranged to face each other on each of the upper and lower plates with the discharge space interposed therebetween.

BRIEF DESCRIPTION OF THE DRAWINGS

The above object and advantages of the present invention will become more apparent by describing in detail preferred embodiments thereof with reference to the attached drawings in which.

DETAILED DESCRIPTION OF THE INVENTION

Figure 4A:
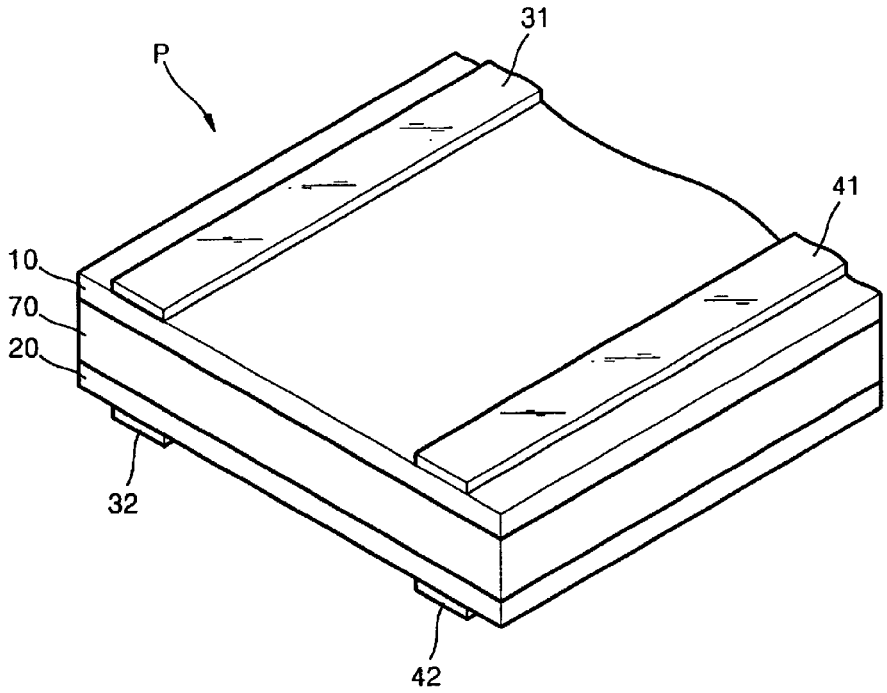
FIG. 4A is a perspective view of a plasma flat lamp according to a first preferred embodiment of the present invention.
Figure 4B:
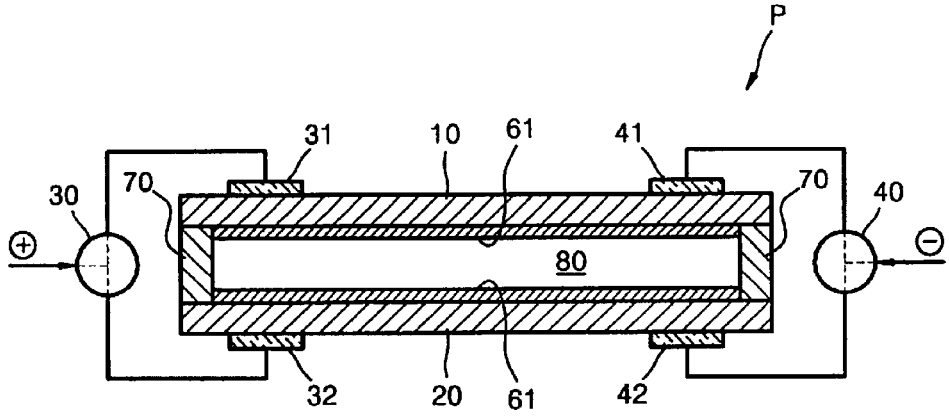
FIG. 4B is a sectional view of the plasma flat lamp of FIG. 4A.

Referring to FIGS. 4A and 4B, in a plasma flat lamp according to a first preferred embodiment of the present invention, an upper plate 10 and a lower plate 20 are separated a predetermined distance from each other and a discharge space 80 filled with a discharge gas is formed therebetween.

A fluorescent layer 61 is formed on each of the upper and lower plates 10 and 20. Pairs of first electrodes 31 and 32 and second electrodes 41 and 42 are provided on the outer surfaces of the upper and lower plates 10 and 20. The pairs of electrodes 31 and 32, and 41 and 42 are arranged to face each other with respect to the discharge space 80. The first upper electrode 31 and the first lower electrode 32 facing each other maintain the same electric potential so that discharge is not induced therebetween. Also, the second upper electrode 41 and the second lower electrode 42 facing each other maintain the same electric potential so that discharge is not induced therebetween. A predetermined difference in electric potential is present between the first electrode pair 31 and 32 and the second electrode pair 41 and 42 so that discharge is induced between the electrode pairs in a direction parallel to the upper plate 10 or the lower plate 20. The first upper plate electrode 31 and the first lower plate electrode 32 constituting the first electrode pair 31 and 32 are electrically connected. The first upper plate electrode 31 and the first lower plate electrode 32 are directly and electrically connected, or are connected by an electric connection unit 30 which can prevent electric interference therebetween and simultaneously maintain the same electric potential.

The second electrode pair 41 and 42 are connected in the same manner as the first electrode pair 31 and 32. That is, the second upper plate electrode 41 and the second lower plate electrode 42 constituting the second electrode pair 41 and 42 are electrically connected. The second upper plate electrode 41 and the second lower plate electrode 42 are directly and electrically connected, or are connected by an electric connection unit 40 which can prevent electric interference therebetween and simultaneously maintain the same electric potential.

The plasma flat lamp shown in FIGS. 4A and 4B has the electrodes 31, 32, 41, and 42 that are not exposed to the discharge space. Electric power applied to the first and second electrode pairs is an alternating voltage or direct current pulse voltage. Since a pure direct current voltage cannot sustain discharge, it cannot be applied to the plasma flat lamp shown in FIGS. 4A and 4B.

Figure 5:
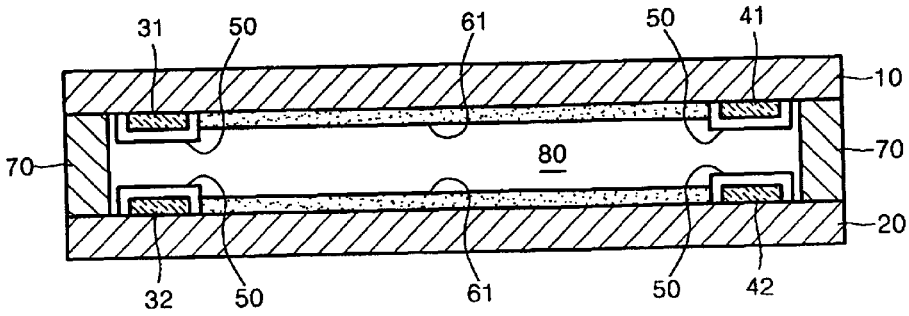
FIG. 5 is a sectional view of a plasma flat lamp according to a second preferred embodiment of the present invention.

FIG. 5 shows a plasma flat lamp according to a second preferred embodiment of the present invention.

The flat lamp of the present invention shown in FIG. 5 is different from the flat lamp shown in FIGS. 4A and 4B in the position of electrodes. In the flat lamp shown in FIGS. 4A and 4B, the electrodes are formed on the outer surfaces of the upper and lower plates 10 and 20. In the second preferred embodiment of the flat lamp of FIG. 5, the electrodes are formed on the inner surfaces of the upper and lower plates 10 and 20.

Referring to FIG. 5, a discharge space 80 filled with a discharge gas is formed between the upper and lower plates 10 and 20 which are separated a predetermined distance from each other by the wall portion 70. The fluorescent layer 61 is formed on each of the inner surfaces of the upper and lower plates 10 and 20. The pairs of the first electrodes 31 and 32 and the second electrodes 41 and 42 are provided on the inner surfaces of the upper and lower plates 10 and 20, close to the wall portion 70. Dielectric layers 50 are formed on each of the electrodes 31, 32, 41, and 42. The dielectric layers 50 are optional in the structure of the present preferred embodiment. The structure of driving voltage for the plasma flat lamp according to the second preferred embodiment of the present invention shown in FIG. 5 is the same as that described with reference to FIGS. 4A and 4B.

Figure 6:
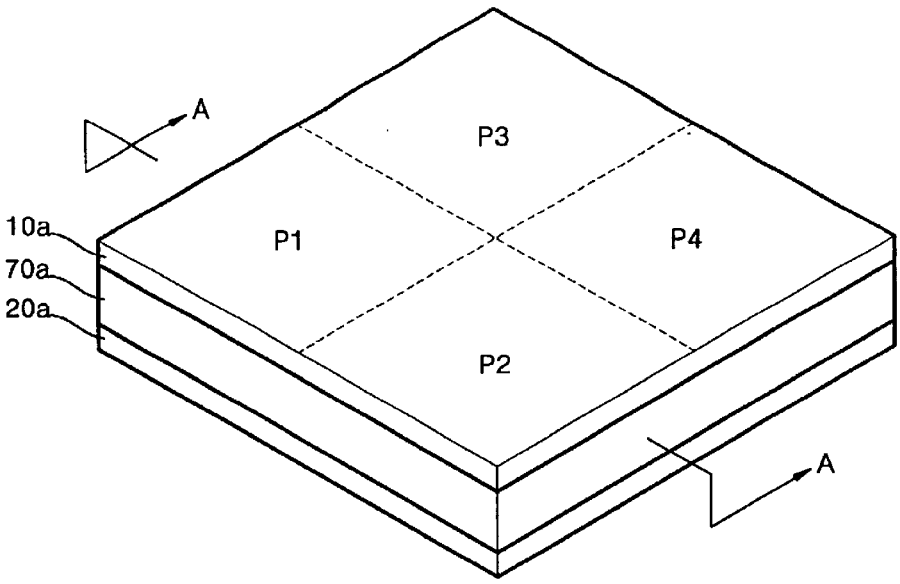
FIG. 6 is a perspective view of a plasma flat lamp according to a third preferred embodiment of the present invention.

FIG. 6 shows a plasma flat lamp according to a third preferred embodiment of the present invention in which the structures according to the second preferred embodiment shown in FIG. 5 are arranged in an array.

Figure 7:
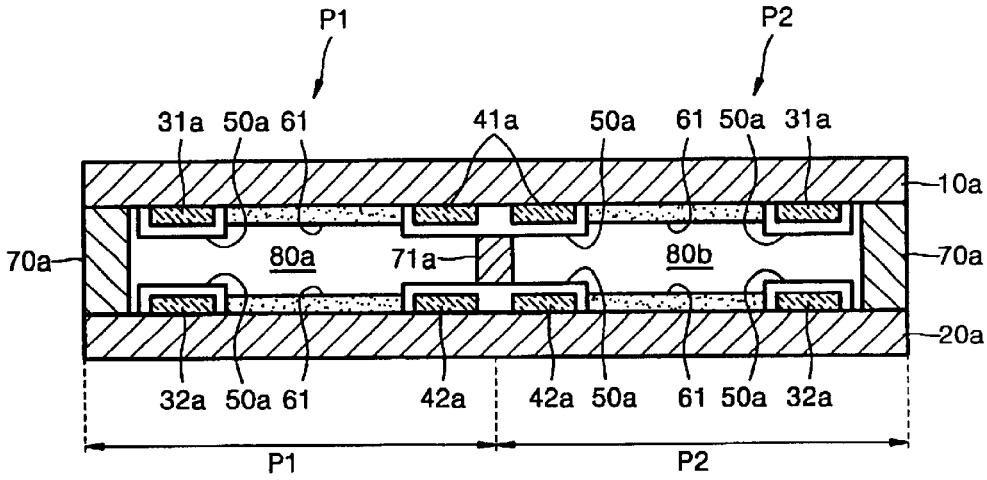
FIG. 7 is a sectional view taken along line A—A of FIG. 6.

As shown in FIG. 6, the entire lamp p is divided into unit discharge areas P1, P2, P3, and P4, each having an independent discharge space. Each of the unit discharge areas P1, P2, P3, and P4 has separate discharge electrodes and the structure of each area is similar to the structure shown in FIG. 5. FIG. 7 is a sectional view taken along line A—A of FIG. 6. Referring to FIG. 7 an upper plate 10*a* and a lower plate 20*a* are separated a predetermined distance from each other by a wall portion 70*a* and a discharge space is provided therebetween. A spacer 71*a* is provided in the discharge space to section the discharge space into unit discharge spaces 80*a* and 80*b* and prevent a lamp from being broken due to a difference in pressure between the inside and the outside of the lamp.

Figure 8:
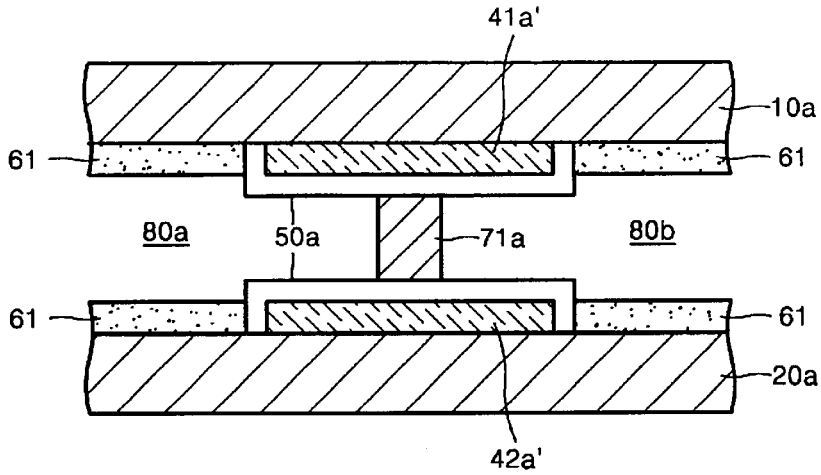
FIG. 8 is a sectional view showing a part of a modified example of a second electrode pair of the plasma flat lamp of FIG. 6.

Each of the unit discharge spaces 80*a* and 80*b* has an independent discharge structure. That is, the discharge spaces 80*a* and 80*b* filled with a discharge gas and maintaining a predetermined distance from each other by the wall portion 70*a* and the spacer 71*a* are formed in each of the discharge spaces P1 and P2 between the upper and lower plates 10*a* and 20*a*. The fluorescent layer 61 is formed on each of the inner surfaces of the upper and lower plates 10*a* and 20*a* of each of the discharge spaces 80*a* and 80*b*. A first pair of electrodes 31*a* and 32*a* and a second pair of electrodes 41*a* and 42*a* are provided on the inner surfaces of the upper and lower plates 10*a* and 20*a* in each of the discharge spaces 80*a* and 80*b*, close to the wall portion 70*a* or the spacer 71*a*. A dielectric layer 50*a* is formed on each of the electrodes 31*a*, 32*a*, 41*a*, and 42*a*. The above structure is useful when a large scale of illumination is needed. In the above structure, the second electrodes 41*a* on the upper plate 10*a* are electrically connected and the second electrodes 42*a* on the lower plate 20*a* are electrically connected. As shown in FIG. 8, each of the second electrodes 41*a* on the upper plate 10*a* and the second electrodes 42*a* on the lower plate 20*a* can be formed integrally as upper and lower common electrodes 41*a*' and 42*a*' and extended toward each of the unit discharge spaces 80*a* and 80*b* with respect to the spacer 71 disposed therebetween.

Figure 9:
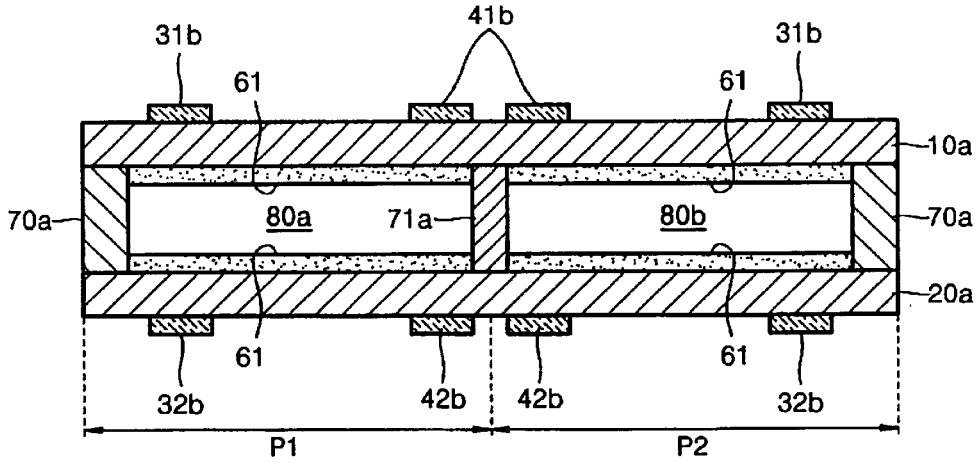
FIG. 9 is a sectional view of a plasma flat lamp according to a fourth preferred embodiment of the present invention.

FIG. 9 is a sectional view of a fourth preferred embodiment of the present invention in which the first preferred embodiment shown in FIGS. 4A and 4B is applied to the array structure of the flat lamp shown in FIGS. 6 and 7. Referring to FIG. 9, the upper plate 10*a* and the lower plate 20*a* are maintained with a predetermined distance and a discharge space is provided therebetween. The spacer 71*a* is provided in the discharge space to divide the discharge space into the unit discharge spaces 80*a* and 80*b* and prevent the lamp from being broken due to a difference in pressure between the inside and outside of lamp. The discharge spaces 80*a* and 80*b* filled with a discharge gas and maintaining a predetermined distance by the wall portion 70*a* and the spacer 71*a* are formed in the discharge areas P1 and P2 between the upper and lower plates 10*a* and 20*a*. The fluorescent layer 61 is formed on each of the inner surfaces of the upper and lower plates 10*a* and 20*a*. A first pair of electrodes 31*b* and 32*b* and a second pair of electrodes 41*b* and 42*b* are provided on the outer surfaces of the upper and lower plates 10*a* and 20*a* corresponding to the respective discharge spaces 80*a* and 80*b*, close to the wall portion 70*a* or the spacer 71*a*. A separate protective layer can be formed on each of the electrodes 31*b*, 32*b*, 41*b*, and 42*b*. The above structure is useful when a large scale of illumination is needed. In the above structure, the second electrodes 41*b* on the upper plate 10*a* are electrically connected and the second electrodes 42*b* on the lower plate 20*a* are electrically connected. As shown in FIG. 8, each of the second electrodes 41*b* on the upper plate 10*a* and the second electrodes 42*b* on the lower plate 20*a* can be formed integrally.

In the above-described preferred embodiments, a reflection layer (not shown) can be interposed between a lower plate (not shown) and the fluorescent layer on the lower plate to reflect light proceeding toward the lower plate back to the upper plate, thus improving luminance. The reflection layer may also be formed at a portion where improvement of luminance is expected, for example, the wall portion. In the above-described where the electrode is formed in the discharge space, when the dielectric layer is not formed on the electrode, the lamp can be driven by a direct current pulse voltage. When there is dielectric and the electrodes are formed on the outer surfaces of the upper and lower plates, the lamp can be driven by an alternating current voltage or an alternating or a direct current pulse voltage.

Figure 10A:
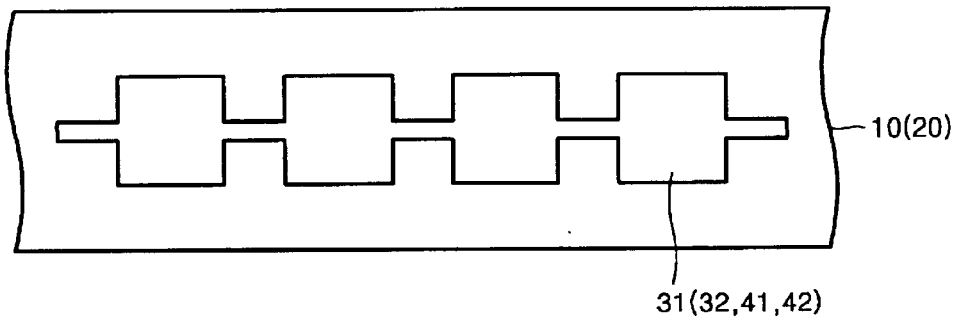
FIG. 10A is a plan view showing a modified example of an electrode adopted to a flat lamp according to the present invention.
Figure 10B:
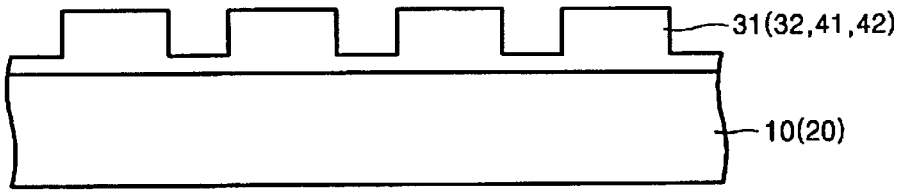
FIG. 10B is a plan view showing another modified example of an electrode adopted to a flat lamp according to the present invention.

The flat lamp of the present invention is operated in a driving method which is well known. A plasma discharge is generated by a voltage applied between the electrodes in the discharge space filled with a discharge gas and the plasma discharge is sustained. Here, high temperature electrons to excite neutral gas atoms and molecules are generated. Ultraviolet rays generated as the atoms and molecules in excited states excited by the electrons fall to the ground state excite the fluorescent layer coated in the discharge space to generate visible rays. To prevent the electrodes coated on the upper plate from being seen by an observer, the upper plate electrodes and the dielectric are formed of substance exhibiting a high light transmittance or a diffuser sheet can be added on the upper plate. To prevent a discharge contraction and encourage a stable discharge, as shown in FIG. 10A, the electrode 10 can be formed such that a portion having a narrow width and a portion having a great width are repeated periodically or, as shown in FIG. 10B, the heights of the electrode 31 and the dielectric layer of the upper plate 10 or the lower plate 20 change periodically. When the electrodes are formed at the outer surfaces of the upper and lower plats, the upper and lower plates work as dielectric. Thus, making the surface of glass uneven has the same effect of giving a change in the height of the dielectric layer.

FIGS. 11A through 14B show the results of simulation of a discharge feature of the flat lamp according to the present invention.

Figure 1:
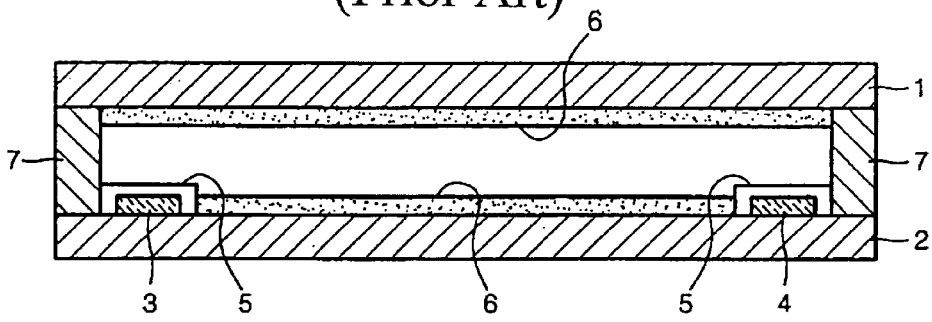
FIG. 1 (Prior Art)
FIG. 1 is a sectional view of a conventional surface discharge type flat lamp.
Figure 2:
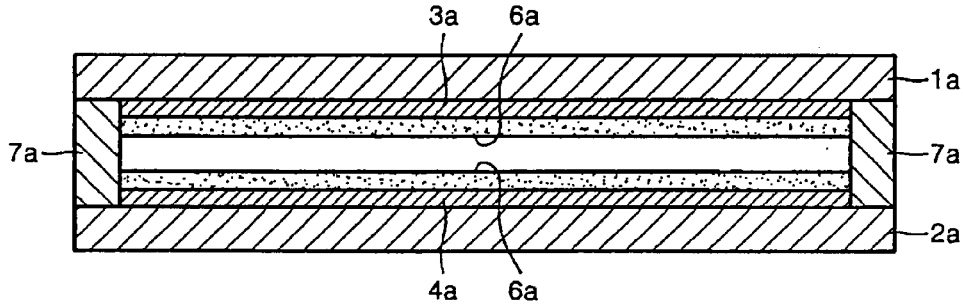
FIG. 2 (Prior Art)
FIG. 2 is a sectional view of a conventional upper and lower plates facing electrodes discharge type flat lamp.
Figure 3:
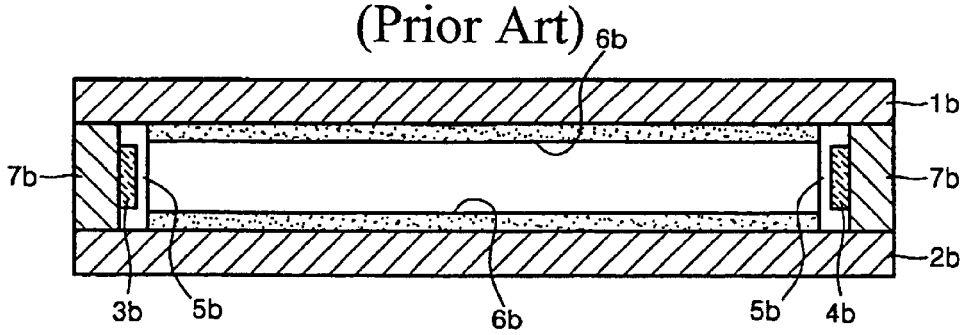
FIG. 3 (Prior Art)
FIG. 3 is a sectional view of a conventional side wall portion facing discharging type flat lamp.
Figure 11A:
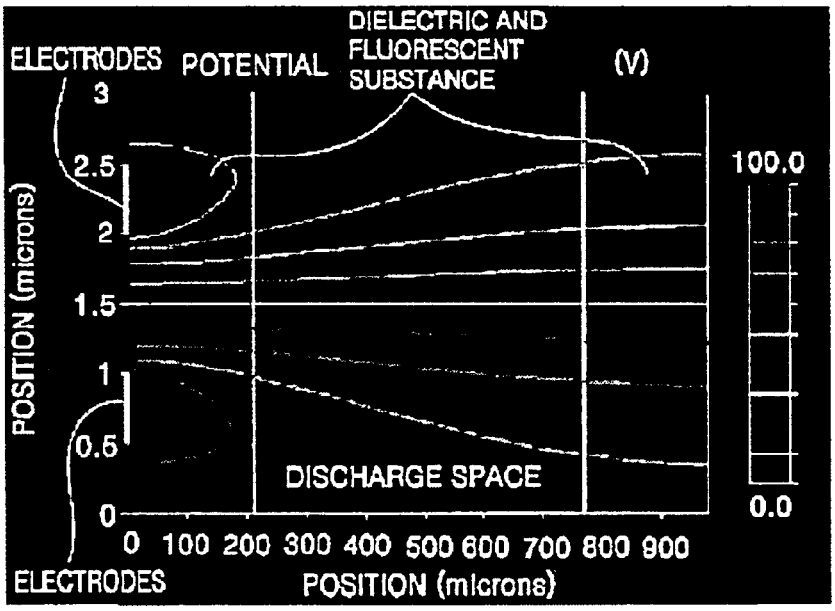
FIGS. 11A and 11B are graphs showing the distribution of electric potential generating when the same conditions are applied to the conventional surface discharge flat lamp of FIG. 1 and the flat lamp of the present invention shown in FIG. 5.
Figure 11B:
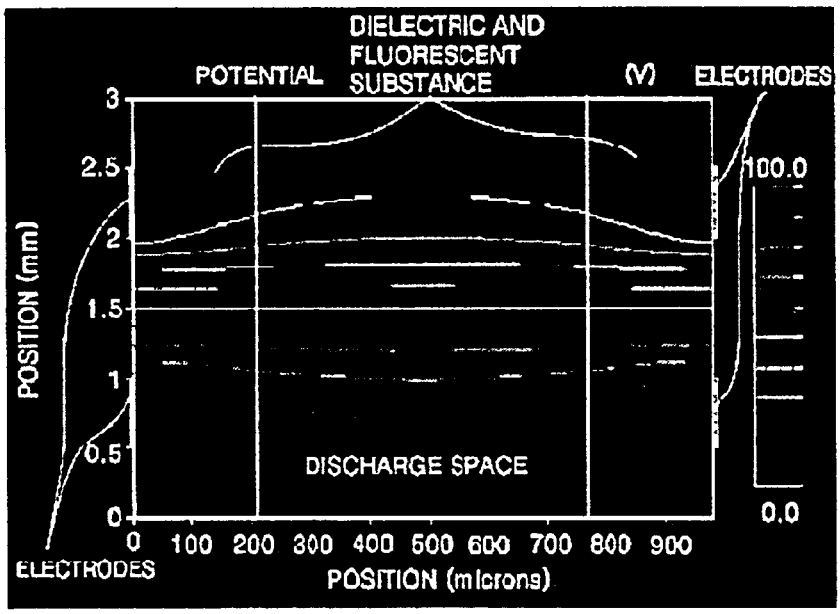

FIGS. 11A and 11B show distribution of electric potential generating under the same conditions with respect to the surface discharge flat lamp in which electrodes are formed on the lower plate like the conventional flat lamp shown in FIG. 1 and the flat lamp of the present invention shown in FIG. 5. In FIGS. 11A and 11B, the distribution of electric potential around the electrodes are curved similarly so that contraction of discharge is less by far compared to a general opposed electrode flat lamp and an effect of decreasing in life span by sputtering is small. However, since the distribution of electric field at the central portion of the flat lamp shown in FIG. 11B is similar to that of the opposed electrode flat lamp, instead of that for the surface discharge flat lamp in FIG. 11A, that is, the electric field is distributed around the center of the lamp.

Figure 12A:
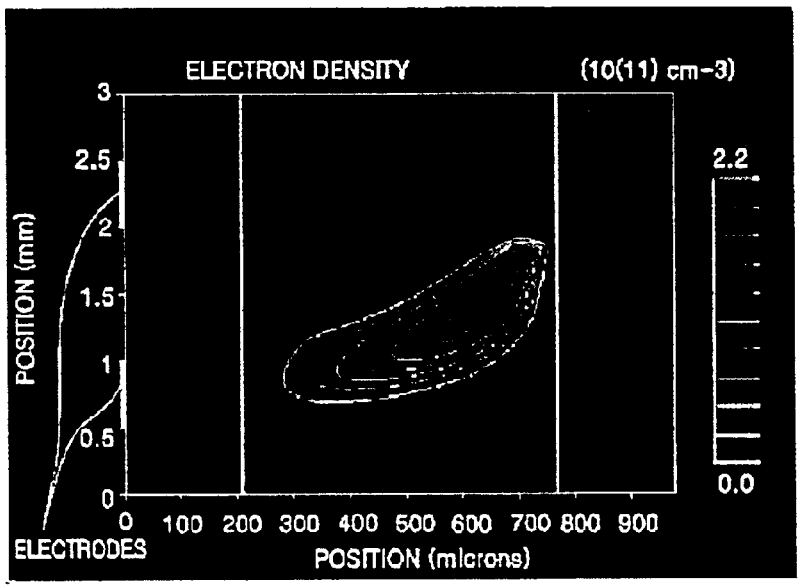
FIGS. 12A and 12B are graphs showing the distribution of electron density at a given instant when the same conditions of FIGS. 11A and 11B are applied to the conventional surface discharge flat lamp of FIG. 1 and the flat lamp of the present invention shown in FIG. 5.
Figure 12B:
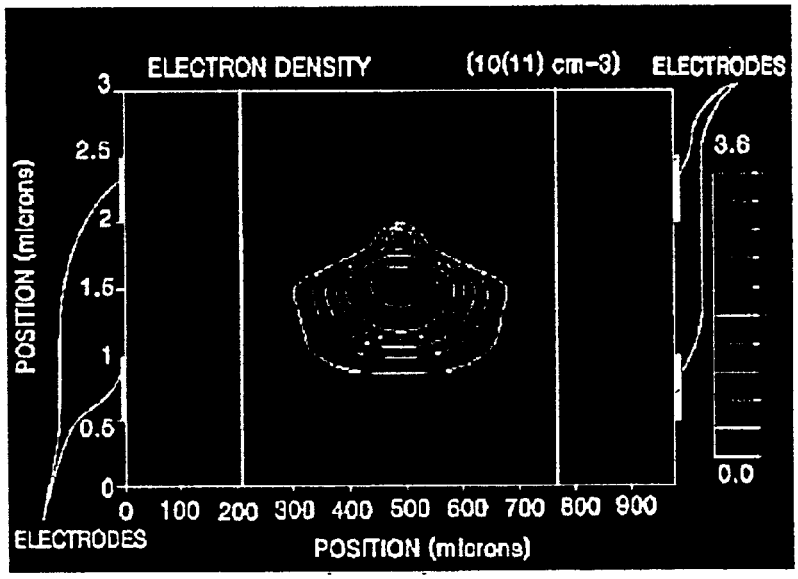

FIGS. 12A and 12B show distribution of density of electrons with respect to the conventional surface discharge flat lamp of FIG. 1 and the flat lamp according to the present invention of FIG. 5. In the flat lamp according to the present invention shown in FIG. 12B, it can be seen that electrons are mainly distributed at the center compared to the density of electrons of the conventional flat lamp of FIG. 12A, so that loss of diffusion, that is, electrons or ions hit the wall portion and disappear, is less.

Figure 13A:
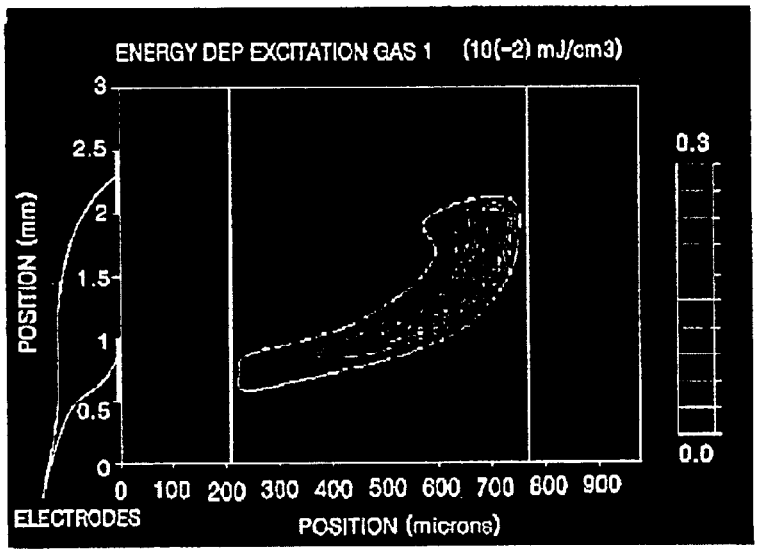
FIGS. 13A and 13B are graphs showing the distribution of energy used to excite Xe with respect to the conventional surface discharge flat lamp of FIG. 1 and the flat lamp of the present invention shown in FIG. 5.
Figure 13B:
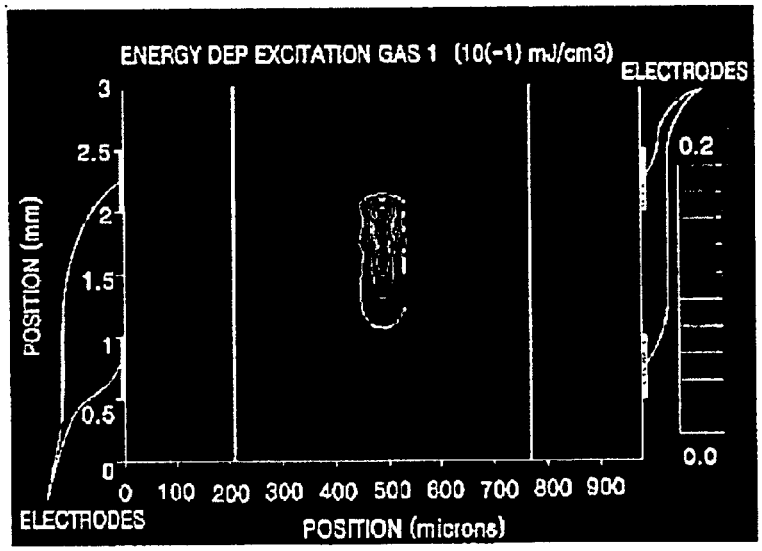

FIGS. 13A and 13B show the distribution of energy used to excite Xe with respect to the conventional surface discharge flat lamp and the flat lamp according to the present invention. When the excited Xe atoms or molecules fall to the ground state, ultraviolet rays are generated and the ultraviolet rays excite fluorescent substance to generate visible rays. Thus, in the same structure, comparison of energy used to excite Xe actually corresponds to comparison of luminance of light emission. In the flat lamp of the present invention, like the case of electron distribution, the energy is mainly distributed at the center so that the density of energy is higher than that of the conventional surface discharge flat lamp of FIG. 1.

Figure 14A:
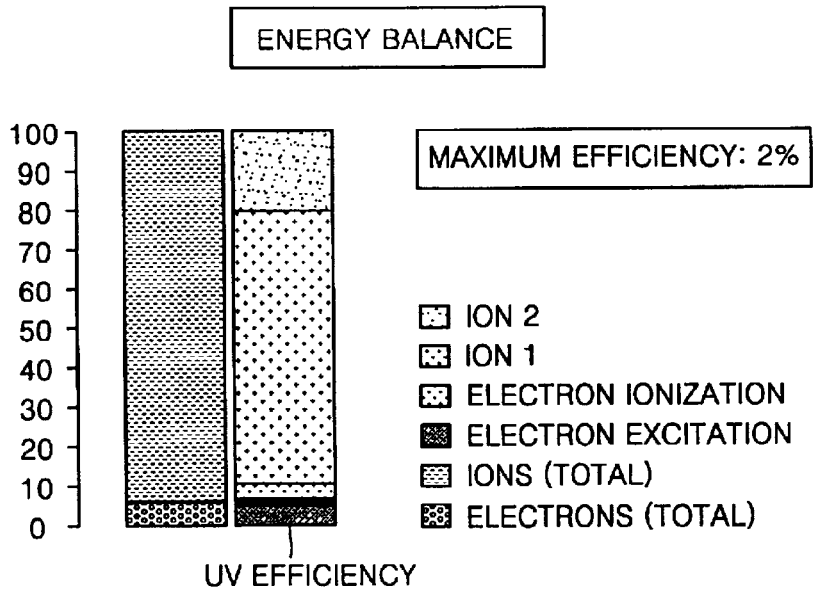
FIGS. 14A and 14B are diagrams showing the percentage of use of input energy in the conventional flat lamp and the flat lamp according to the present invention.
Figure 14B:
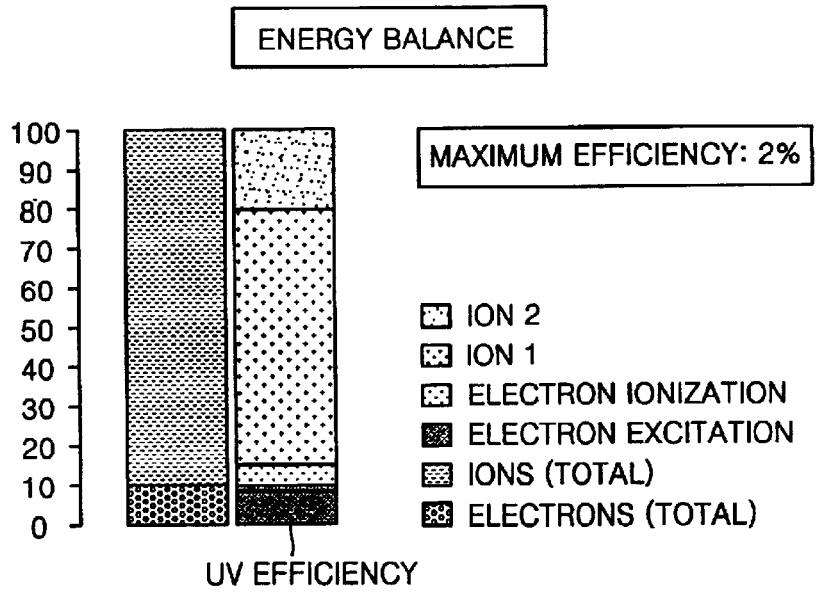

FIGS. 14A and 14B show the use of input energy by percentage in the conventional flat lamp and the flat lamp according to the present invention, respectively. Since the energy which contributes to actual light emission is the energy used to excite neutral particles by electrons, the efficiency of light emission can be compared by comparing the ratio of the energy used for the excitation with respect to the overall energy. The ratio of the energy used for the excitation with respect to the overall energy is referred to as a UV efficiency. As shown in FIGS. 14A and 14B, under the same conditions, the UV efficiency of the flat lamp of the present invention of FIG. 14B is 5% which is higher than 2% of the conventional flat lamp shown in FIG. 14A.

Figure 15:
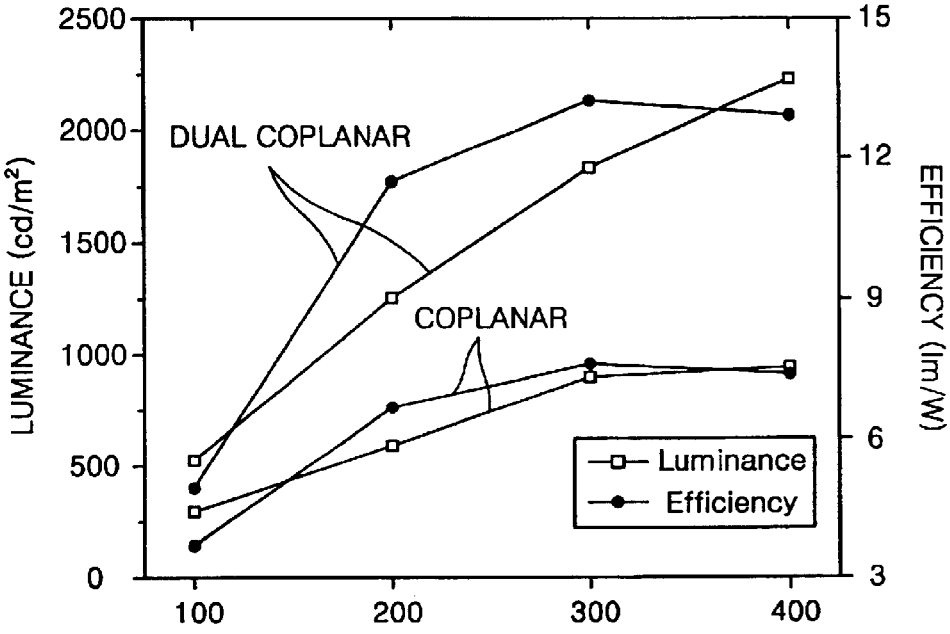
FIG. 15 is a graph showing the result of a test between the conventional flat lamp and the flat lamp according to the present invention having the same size with respect to a Xe(4%)/Ne mixed gas.

FIG. 15 shows the result of a test of actual products of the conventional flat lamp and the flat lamp according to the present invention having the same size with respect to a mixed gas of Xe(4%)/Ne. A driving frequency is 15.2 kHz, the flat lamps are driven by AC pulse, and the peak voltage of a driving pulse is 2.8 kV. The luminance and efficiency of the flat lamp of the present invention are higher than those of the conventional flat lamp.

As described above, the plasma flat lamp according to the present invention has a stable discharge feature which is a merit of the conventional surface discharge flat lamp and a high luminance of light emission which is a feature of the facing electrodes discharge type, while not having a low luminance and unstable discharge feature of the conventional surface discharge type flat lamp and facing electrodes discharge flat lamp, respectively.

While this invention has been particularly shown and described with reference to preferred embodiments thereof, it will be understood by those skilled in the art that various changes in form and details may be made therein without departing from the spirit and scope of the invention as defined by the appended claims.

What is claimed is:

1. A plasma flat lamp comprising:

an upper plate;

a lower plate separated a predetermined distance from the upper place;

a wall portion for forming a sealed discharge space between the upper and lower plates;

a discharge gas filled in the discharge space;

a spacer for dividing the discharge space into a plurality of unit discharge spaces;

a plurality of first electrode pairs including a first upper plate electrode and a first lower plate electrode arranged to face each other at each of the unit discharge spaces, the first upper and lower plate electrodes of each first electrode pair being provided on the respective upper and lower plates of each of the unit discharge spaces with the corresponding unit discharge space interposed therebetween; and a plurality of second electrode pairs including a second upper plate electrode and a second lower plate electrode arranged to face each other at each of the unit discharge spaces, the second upper and lower plate electrodes of each second electrode pair being separated a predetermined distance from the first upper and lower plate electrode, respectively, at each of the unit discharge spaces, and being provided on the respective upper and lower plates of each of the unit discharge spaces with the corresponding unit discharge space interposed therebetween.

2. The plasma flat lamp as claimed in claim 1, wherein the first and second electrode pairs corresponding to the unit discharge spaces are formed on the outer surfaces of the upper and lower plates.

3. The plasma flat lamp as claimed in claim 2, wherein a reflection layer is formed between a lower plate and a fluorescent layer formed on the inner surfaced of the lower plate.

4. The plasma flat lamp as claimed in claim 2, wherein the first and second upper plate electrodes are formed o light transmitting substance.

5. The plasma flat lamp as claimed in claim 1, wherein the first and second electrode pairs corresponding to the unit discharge spaces are formed on the inner surfaces of the upper and lower plates.

6. The plasma flat lamp as claimed in claim 5, wherein a reflection layer is formed between a lower plate and a fluorescent layer formed on the inner surface of the lower plate.

7. The plasma flat lamp as claimed in claim 2, wherein a reflection layer is formed on the inner surface of the wall portion.

8. The plasma flat lamp as claimed in claim 5, wherein a reflection layer is formed on the inner surface of the wall portion.

9. The plasma flat lamp as claimed in claim 5, wherein the first and second upper plate electrodes are formed of light transmitting substance.

10. The plasma flat lamp as claimed in claim 5, wherein a dielectric layer is formed on each of the electrodes forming the electrode pairs so that the electrodes are in a non-contact state with respect to the discharge gas.

11. The plasma flat lamp as claimed in claim 10, wherein a reflection layer is formed between a lower plate and a fluorescent layer formed on the inner surface of the lower plate.

12. The plasma flat lamp as claimed in claim 10, wherein a reflection layer is formed on the inner surface of the wall portion.

13. The plasma flat lamp as claimed in claim 10, wherein the first and second upper plate electrodes are formed of light transmitting substance.

14. The plasma flat lamp as claimed in claim 1, wherein a reflection layer is formed between a lower plate and a fluorescent layer formed on the inner surface of the lower plate.

15. The plasma flat lamp as claimed in claim 1, wherein a reflection layer is formed on the inner surface of the wall portion.

16. The plasma flat lamp as claimed in claim 1, wherein the first and second upper plate electrodes are formed of light transmitting substance.

17. A plasma flat lamp comprising:

an upper plate;

a lower plate separated a predetermined distance from the upper plate;

a wall portion for forming a sealed discharge space between the upper and lower plates;

a discharge gas filled in the discharge space;

a spacer for dividing the discharge space into a plurality of unit discharge spaces;

a plurality of first electrode pairs configured to maintain a same first electric potential including a first upper plate electrode and a first lower plate electrode arranged to face each other on each of the upper and lower plates with the discharge space interposed therebetween; and a plurality of second electrode pairs configured to maintain a same second electric potential different from the first electric potential including a second upper plate electrode separated a predetermined distance from the first upper plate electrode and a second lower plate electrode separated a predetermined distance from the first lower plate electrode arranged to face each other on each of the upper and lower plates with the discharge space interposed therebetween.

18. The plasma flat lamp as claimed in claim 17, wherein the first and second electrode pairs corresponding to the unit discharge spaces are formed on the outer surfaces of the upper and lower plates.

19. The plasma flat lamp as claimed in claim 18, wherein a reflection layer is formed between a lower plate and a fluorescent layer formed on the inner surface of the lower plate.

20. The plasma flat lamp as claimed in claim 18, wherein a reflection layer is formed on the inner surface of the wall portion.

21. The plasma flat lamp as claimed in claim 18, wherein the first and second upper plate electrodes are formed of light transmitting substance.

22. The plasma flat lamp as claimed in claim 17, wherein the first and second electrode pairs corresponding to the unit discharge spaces are formed on the inner surfaces of the upper and lower plates.

23. The plasma flat lamp as claimed in claim 22, wherein a reflection layer is formed between a lower plate and a fluorescent layer formed on the inner surface of the lower plate.

24. The plasma flat lamp as claimed in claim 22, wherein a reflection layer is formed on the inner surface of the wall portion.

25. The plasma flat lamp as claimed in claim 22, wherein the first and second upper plate electrodes are formed of light transmitting substance.

26. The plasma flat lamp as claimed in claim 22, wherein a dielectric layer is formed on each of the electrodes forming the electrode pairs so that the electrodes are in a non-contact state with respect to the discharge gas.

27. The plasma flat lamp as claimed in claim 26, wherein a reflection layer is formed between a lower plate and a fluorescent layer formed on the inner surface of the lower plate.

28. The plasma flat lamp as claimed in claim 26, wherein a reflection layer is formed on the inner surface of the wall portion.

29. The plasma flat lamp as claimed in claim 26, wherein the first and second upper plate electrodes are formed of light transmitting substance.

30. The plasma flat lamp as claimed in claim 17, wherein a reflection layer is formed between a lower plate and a fluorescent layer formed on the inner surface of the lower plate.

31. The plasma flat lamp as claimed in claim 17, wherein a reflection layer is formed on the inner surface of the wall portion.

32. The plasma flat lamp as claimed in claim 17, wherein the first and second upper plate electrodes are formed of light transmitting substance.

* * * * *